US007284530B2

(12) United States Patent
Nagasaki et al.

(10) Patent No.: US 7,284,530 B2
(45) Date of Patent: Oct. 23, 2007

(54) LEAK DETECTOR FOR FUEL VAPOR PURGE SYSTEM

(75) Inventors: Kenji Nagasaki, Nagoya (JP); Tokiji Ito, Toyota (JP); Hideki Miyahara, Nishikamo-gun (JP)

(73) Assignees: Denso Corporation, Kariya, Aichi-pref. (JP); Toyota Jidosha Kabushiki Kaisha, Toyota, Aichi-pref. (JP)

( * ) Notice: Subject to any disclaimer, the term of this patent is extended or adjusted under 35 U.S.C. 154(b) by 65 days.

(21) Appl. No.: 11/264,152

(22) Filed: Nov. 2, 2005

(65) Prior Publication Data

US 2006/0090553 A1 May 4, 2006

(30) Foreign Application Priority Data

Nov. 2, 2004 (JP) ..... 2004-318645

(51) Int. Cl.
*F02B 77/08* (2006.01)

(52) U.S. Cl. ..... 123/198 D; 123/520; 73/118.1

(58) Field of Classification Search ..... 123/198 D, 123/520, 519, 518, 516; 73/118.1, 40.5, 73/49.7

See application file for complete search history.

(56) References Cited

U.S. PATENT DOCUMENTS 5,297,529 A 3/1994 Cook et al.
5,317,909 A 6/1994 Yamada et al.
5,890,474 A 4/1999 Schnaibel et al.
6,550,315 B2 4/2003 Streib
6,722,348 B2 4/2004 Nagasaki et al.
6,761,154 B2 * 7/2004 Takagi et al. ..... 123/520
6,834,535 B2 * 12/2004 Kano et al. ..... 73/49.7
6,848,298 B2 2/2005 Miyahara et al.
6,993,957 B2 * 2/2006 Kano et al. ..... 73/49.7
2004/0000187 A1 * 1/2004 Kobayashi et al. ..... 73/49.7
2004/0173013 A1 * 9/2004 Kobayashi et al. ..... 73/118.1
2005/0011185 A1 * 1/2005 Annoura et al. ..... 60/289
2005/0044939 A1 * 3/2005 Kobayashi et al. ..... 73/118.1
2006/0016253 A1 * 1/2006 Kobayashi et al. ..... 73/118.1

FOREIGN PATENT DOCUMENTS

JP 11-336619 12/1999
JP 2000-205056 7/2000
WO 95/10701 4/1995

* cited by examiner

*Primary Examiner*—Carl S. Miller
(74) *Attorney, Agent, or Firm*—Nixon & Vanderhye P.C.

(57) ABSTRACT

A suction pump introduces negative pressure into a reference-pressure-detecting portion. A driving voltage V of the suction pump is adjusted in such a manner that pressure Pr in the reference-pressure-detecting portion is within a target pressure range. When the pressure Pr is brought into the target pressure range, the driving voltage V of the suction pump is stored as a first driving voltage V1 and the pressure Pr is stored as a reference pressure Pr. When pressure detection and leak detection process are conducted, the suction pump is driven at the first driving voltage V1 to introduce the negative pressure. The computer compares the pressure Pr with a leak determination value to determine whether a leak exists.

12 Claims, 10 Drawing Sheets

FIG. 11
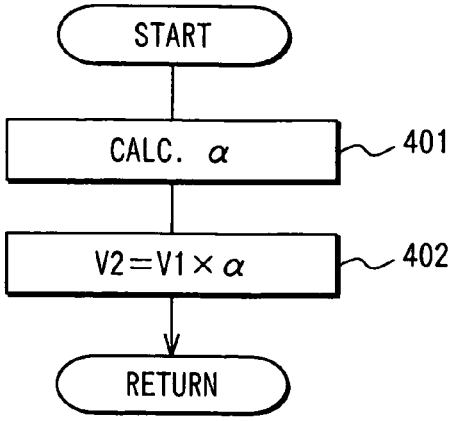
FIG. 12
| SECOND APERTURE (mm) | 0.4 | 0.5 | 0.6 | 0.7 |
|---|---|---|---|---|
| α | 0.7 | 1.0 | 1.4 | 1.9 |
FIG. 13
RELATED ART
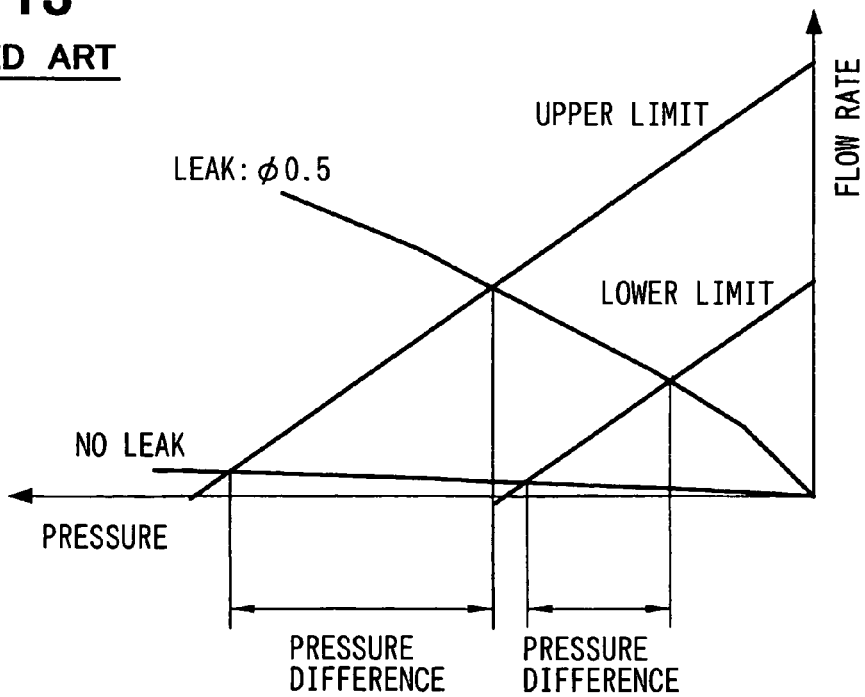

LEAK DETECTOR FOR FUEL VAPOR PURGE SYSTEM

CROSS REFERENCE TO RELATED APPLICATIONS

This application is based on Japanese Patent Application No. 2004-318645 filed on Nov. 2, 2004, the disclosure of which is incorporated herein by reference.

1. Field of the Invention

The present invention relates to a leak detector for fuel vapor purge system. The fuel vapor purge system introduces fuel vapor generated in a fuel tank into an intake pipe of the internal combustion engine. The leak detector determines whether a leak exists in the fuel vapor purge system.

2. Background of the Invention

The fuel vapor purge system includes a canister communicated to a fuel tank and a purge-control vale disposed between the canister and the intake pipe. The canister absorbs the fuel vapor which is generated in a fuel tank. When the purge-control valve is opened, the fuel vapor absorbed in the canister is introduced into the intake pipe by intake pressure which is negative pressure, so that the fuel vapor is prevented from leaking into atmosphere. If the fuel vapor purge system has a leakage hole therein, the fuel vapor leaks into the atmosphere. Thus, it is important to detect a leak in the fuel vapor purge system as soon as possible.

JP-05-125997A (U.S. Pat. No. 5,317,909) shows a conventional leak detector in which a purge-control valve is opened to introduce negative pressure into a fuel tank, and then the purge-control valve is closed to close a fuel vapor purge system including the fuel tank and a canister. Under such a condition, variation in pressure of the fuel vapor purge system is measured to be compared with a leak determining value, so that whether the leak exists in the fuel vapor purge system is determined. However, this leak detector cannot detect a minor leak and size of the leak precisely.

JP-2000-205056A shows another conventional leak detector in which an electric motor introduces positive pressure into a reference-pressure detecting portion to detect a reference pressure which is restricted by a reference orifice. And then, the electric motor introduces positive pressure into the fuel vapor purge system to detect the pressure in the fuel vapor purge system. When the pressure in the fuel vapor purge system are detected, the electric motor is driven by the same voltage as the time when the reference pressure is detected. Comparing the reference pressure with the pressure in the fuel vapor purge system, the minor leak and the size of the leak can be detected. When the positive pressure is introduced into the reference-pressure detecting portion, the electric motor is driven at voltage V1. When the positive pressure is introduced into the fuel vapor purge system, the electric motor is driven at voltage V2, which is higher than the voltage V1, for a certain time period, and then the electric motor is driven at the voltage V1 again.

The electric pump has a variation in characteristic thereof due to production tolerance and aging. The characteristic is, for example, a relationship between a driving voltage and a discharge amount. In the leak detector shown in JP-2000-205056A, the electric pump is always driven at the voltage V1 without considering the variation of the characteristic. Thus, the positive pressure introduction condition (for example, discharge amount of the electric pump) varies when the reference pressure and the pressure in the system are detected.

The variation in the positive pressure introduction condition varies the reference pressure, so that an accuracy of leak detection varies. Besides, a case in which a suction pump is used will be explained referring to FIG. 13. In a fuel vapor purge system in which the characteristic of the suction pump is brought to be close to a lower limit, the discharge amount of the suction pump is decreased. Thus, the pressure difference between a case that a leak exists and a case that no leak exists is decreased to deteriorate the accuracy of leak detection. On the other hand, in the fuel vapor system in which the characteristic of the suction pump is brought to be close to an upper limit, the discharge amount of the suction amount is increased. The negative pressure at the time of detecting the pressure in the fuel vapor purge system is increased. That is, the pressure difference relative to the atmospheric pressure is increased. Thus, the inner pressure applied to the fuel vapor purge system is increased to deteriorate durability thereof.

SUMMARY OF THE INVENTION

The present invention is made in view of the foregoing matter and it is an object of the present invention to provide a leak detector for a fuel vapor purge system which is able to stabilize a pressure introduction condition at the time of detecting a leak without being affected by a variation of characteristic of a pressure introduction means. The leak detector is able to enhance accuracy of the leak detection and durability thereof.

According to the present invention, a leak detector includes a pressure introducing means, a reference-pressure-detecting portion provided with a reference aperture, a switching mean for switching between a passage for introducing the pressure into the reference-pressure-detecting portion and a passage for introducing the pressure into the fuel vapor purge system, and a leak determination means.

The leak determination means detects a reference pressure information representing a reference pressure adjusted by the reference aperture or a correlating information of the reference pressure. The leak determination means detects a system pressure information representing a system pressure in the fuel vapor purge system or a correlating information of the system pressure. And then, the leak determination means determines whether a leak exists by comparing the reference pressure information with the system pressure information. The leak determination means adjusts a control value of the pressure introducing means in such a manner that the reference pressure information becomes the target condition to set the control value as a first control value, and drives the pressure introducing means at the first control value during a detecting operation of the system pressure information.

BRIEF DESCRIPTION OF THE DRAWINGS

The above and other objects, features, and advantages of the present invention will become more apparent from the following detailed description made with reference to the accompanying drawings, in which like parts are designated by like reference number and in which:

FIG. 11 is a flowchart showing a second voltage calculation process;

FIG. 12 is a table schematically showing a table of a correction coefficient α; and FIG. 13 is a graph for explaining a problem in a conventional apparatus.

DETAILED DESCRIPTION OF THE PREFERRED EMBODIMENTS

Embodiments of the present invention will be described hereinafter with reference to the drawings.

First Embodiment

Referring to FIGS. 1 to 8, a first embodiment is described hereinafter.

Figure 1:
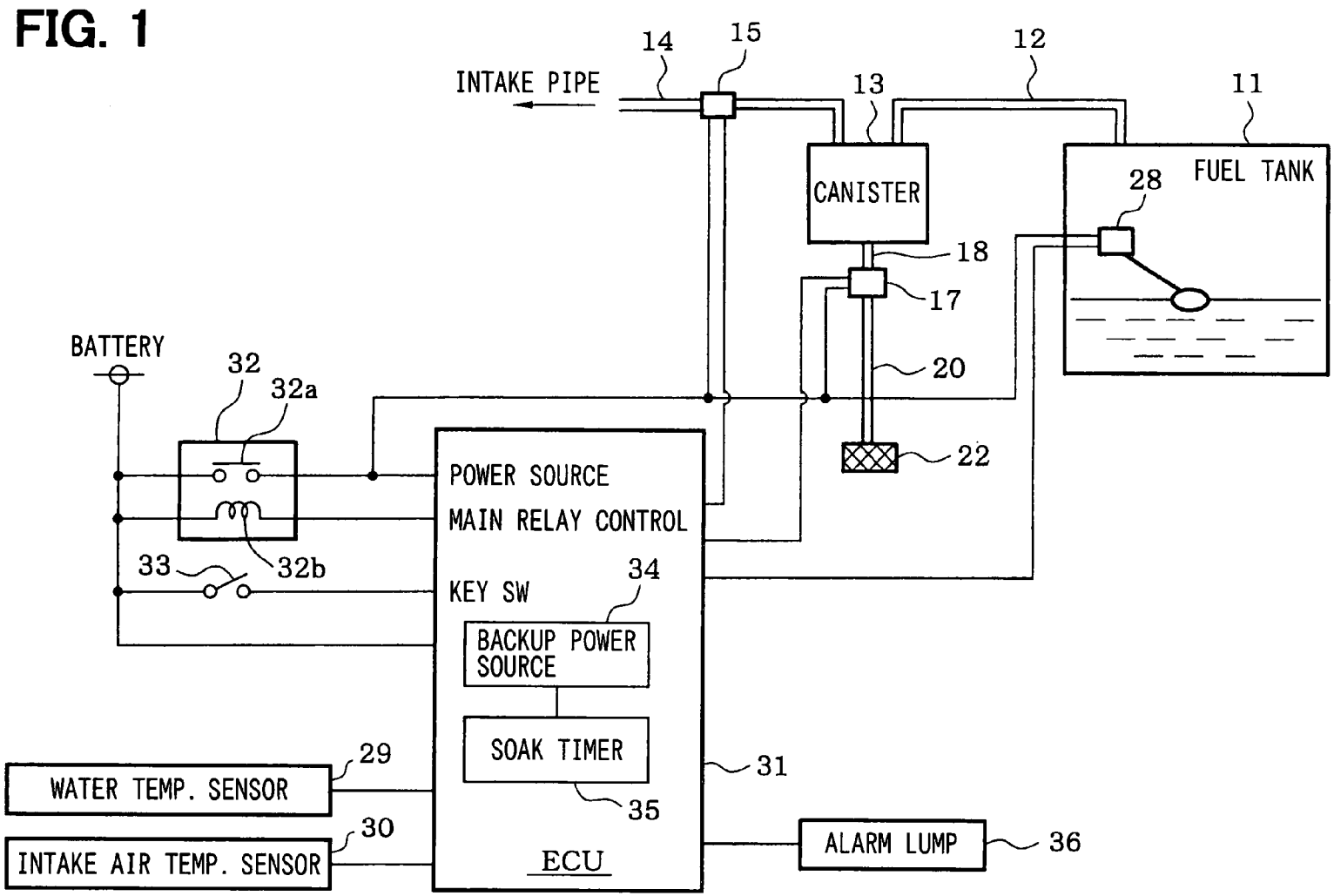
FIG. 1 is a schematic view showing a fuel vapor purge system according to a first embodiment.

FIG. 1 is a schematic view of a fuel vapor purge system. A canister 13 is connected to a fuel tank 11 through an evaporation passage 12. The canister 13 accommodates an absorber such as an activated carbon (not shown) which absorbs fuel vapor generated in the fuel tank 11.

A purge passage 14 connects the canister 13 with an intake pipe of the engine (not shown) in order to purge the absorbed fuel vapor from the canister 13 and introduce the purged fuel vapor into the intake pipe. The purge passage 14 has a purge-control valve 15 in order to control the amount of purged fuel vapor which is introduced into the intake pipe. The purge-control valve 15 is a normally closed valve driven by duty-control.

Figure 2:
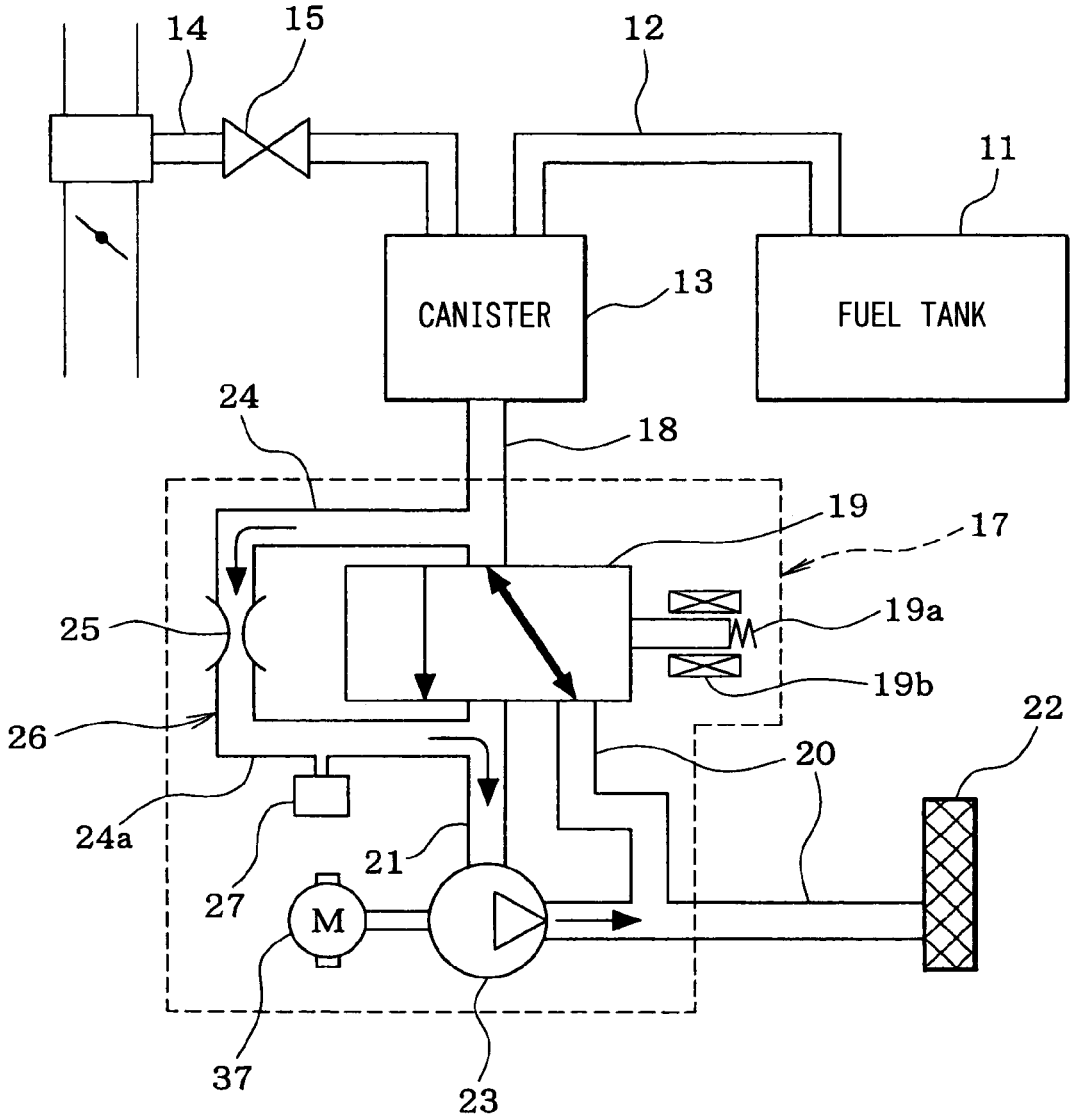
FIG. 2 is a schematic view showing a leak check model in a situation that a reference pressure detecting process is conducted.
Figure 3:
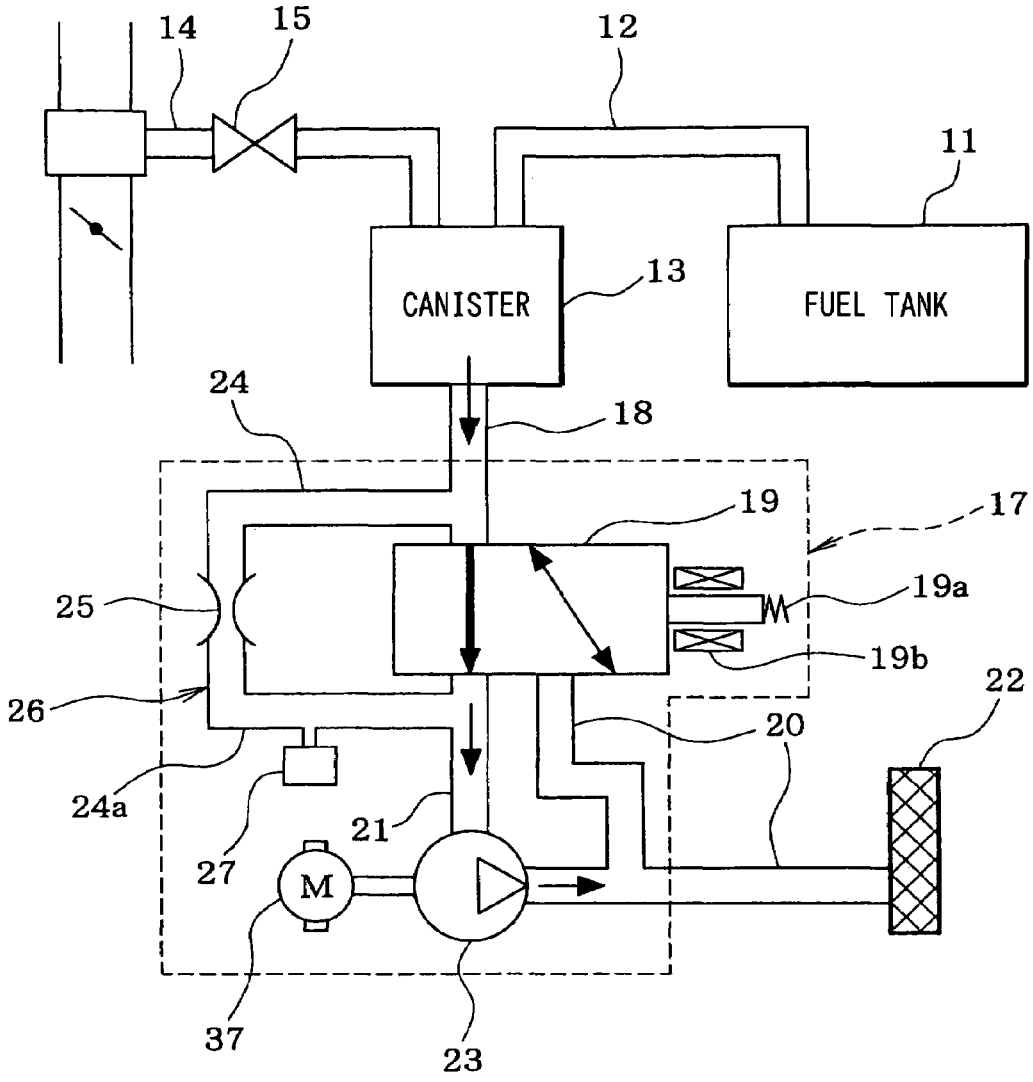
FIG. 3 is a schematic view showing a leak check model in a situation that a system pressure detecting process is conducted.

A leak check module 17 (pressure introduction detecting apparatus) is connected to the canister 13. As shown in FIGS. 2 and 3, the leak check module 17 has a canister-communicating passage 18 which is connected to the canister 13. The canister-communicating passage 18 is connected to an atmosphere-communicating passage 20 and a negative-pressure-introducing passage 21 through a passage-switching valve 19 (switching means). The atmosphere-communicating passage 20 is opened to the atmosphere through a filter 22. The negative-pressure-introducing passage 21 is connected to the atmosphere-communicating passage 20 through an electric suction pump 23 (pressure introducing means). A motor 37 drives the electric suction pump 23 which introduces the purged fuel vapor from the negative-pressure-introducing passage 21 to the atmosphere-communicating passage 20.

The passage-switching valve 19 is an electromagnetic valve which is switched between an atmosphere-releasing position (shown in FIG. 2) and a negative-pressure introducing position (shown in FIG. 3). The passage-switching valve 19 connects the canister-communicating passage 18 with the atmosphere-communicating passage 20 at the atmosphere-releasing position, and connects the canister-communicating passage 18 with the negative-pressure-introducing passage 21 at the negative-pressure introducing position. When a solenoid 19*b* is deenergized, the passage-switching valve 19 is biased to the atmosphere-releasing position by a spring 19*a*, and when energized, the passage-switching valve 19 is moved to the negative-pressure introducing position.

A bypass passage 24 is connected to the canister-communicating passage 18 and the negative-pressure-introducing passage 21 in such a manner as to bypass the passage-switching valve 19. The bypass passage 24 includes a reference orifice 25 (reference aperture) of which diameter is a reference leak diameter (for example, 0.5 mm). The reference orifice 25 and a passage 24*a* connecting the reference orifice 25 with the negative-pressure-introducing passage 21 form a reference-pressure-detecting portion 26. A pressure senor 27 is provided in the reference-pressure-detecting portion 26.

As shown in FIG. 2, when the passage-switching valve 19 is at the atmosphere-releasing position and the purge-control valve 15 is closed, the bypass passage 24 (reference-pressure-detecting portion 26) is opened to the atmosphere through the canister-communicating passage 18 and the atmosphere-communicating passage 20. The pressure sensor 27 detects the pressure in the reference-pressure-detecting portion 26 as atmospheric pressure.

When the suction pump 23 is driven under this situation, the pressure in the reference-pressure-detecting portion 26 becomes negative pressure by the reference orifice 25. At this time, the pressure senor 26 detects the pressure in the reference-pressure-detecting portion 26 as a reference pressure which corresponds to diameter of the reference orifice 25.

When the passage-switching valve 19 is at the negative-pressure introducing position and the purge-control valve 15 is closed as shown in FIG. 3, the fuel vapor purge system which is comprised of the fuel tank 11, the evaporation passage 12, the canister 13 and the purge passage 14 is tightly closed. The reference-pressure-detecting portion 26 is connected to the fuel vapor purge system through the negative-pressure-introducing passage 21 and the canister-communicating passage 18, so that the pressure sensor 27 can detects the pressure in the fuel vapor purge system.

When the suction pump 23 is driven under the situation in which the fuel vapor purge system is closed, the fuel vapor in the fuel vapor purge system is expelled into the atmosphere through the canister-communicating passage 18, the passage-switching valve 19, the suction pump 23, and the atmosphere-communicating passage 20, so that the negative pressure is introduced into the fuel vapor purge system.

As shown in FIG. 1, a fuel level sensor 28 for detecting amount of fuel in the fuel tank 11 is provided in the fuel tank 11. A water temperature sensor 29 detecting a coolant temperature, and an intake air temperature sensor 30 detecting an intake air temperature are provided.

Output signals from the sensors are inputted into an electronic control unit (ECU) 31. The ECU 31 receives main power voltage from a vehicle-mounted battery (not shown) through a main relay 32.

The main power voltage is supplied to the purge-control valve 15, the passage-switching valve 19, the suction pump 23, the pressure senor 27 and the fuel level sensor 28 through the main relay 32. A relay coil 32*b* driving a relay contact 32*a* of the main relay 32 is connected to a main relay terminal of the ECU 31. When the relay coil 32*b* is energized, the relay contact 32*a* is closed to supply the main power voltage to the ECU 31 and the like. When the relay coil 32*b* is deenergized, the relay contact 32*a* is opened to stop supplying of the main power voltage to the ECU 31 and the like.

An ON/OFF signal from an ignition switch 33 is inputted into a key switch terminal of the ECU 31. When the ignition switch 33 is turned on, the main relay 32 is turned on to supply the main power voltage to the ECU 31 and the like. When the ignition switch 33 is turned off, the main relay 32 is turned off to stop the main power voltage supply.

The ECU 31 includes a backup power source 34 and a soak timer 35 which is operated by means of the backup power source 34. The soak timer 35 starts to count when the engine is stopped and counts elapsed time since the engine is stopped. In order to detect the leak of the fuel vapor purge system with the engine off, when a predetermined period has passed since the engine is turned off, the main relay 32 is turned on by means of the backup power source so that the main power voltage is supplied to the ECU 31, the purge-control valve 19, the suction pump 23, the pressure sensor 27, the fuel level sensor, and the like.

The ECU 31 is mainly comprised of a microcomputer executing a fuel injection control program, an ignition timing control program, and a purge control program which are stored in a read only memory (ROM).

Figure 6:
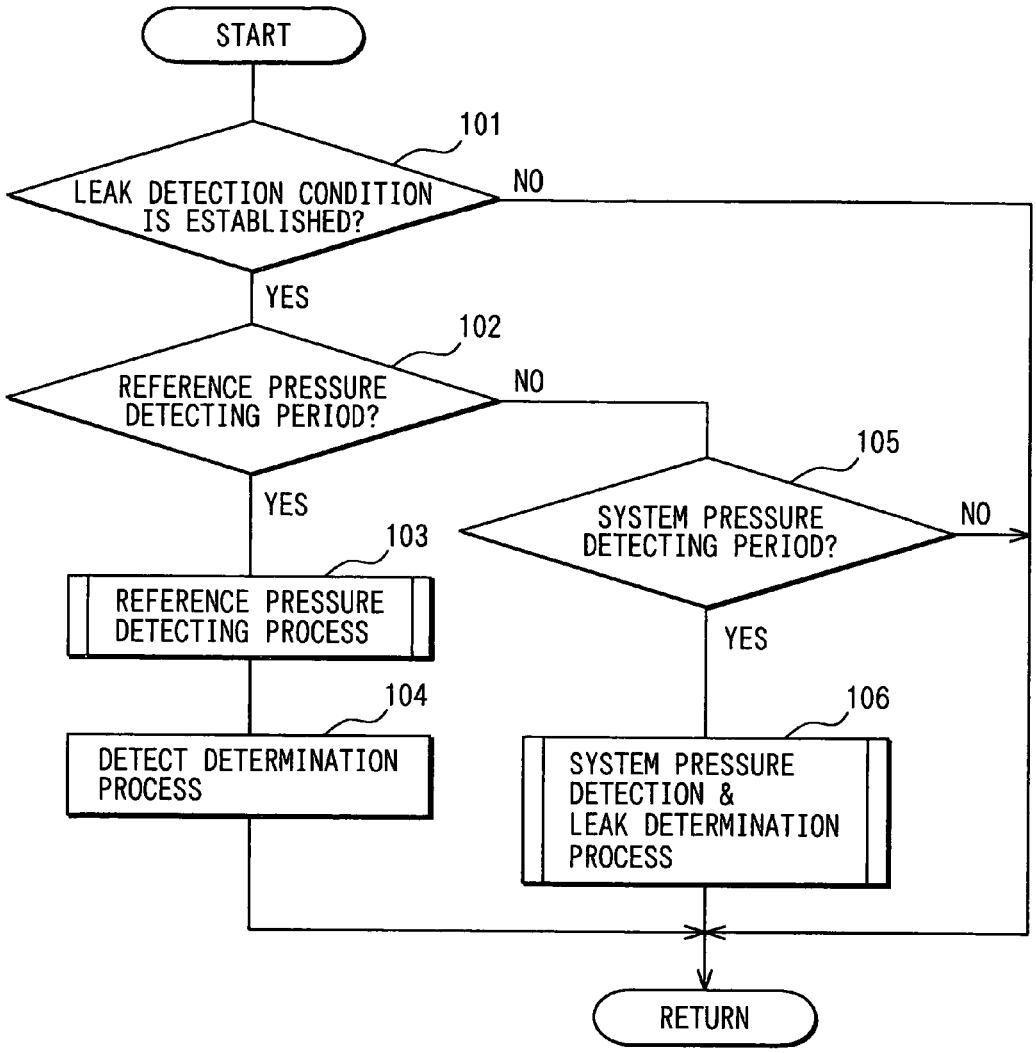
FIG. 6 is a flowchart showing a main control process for leak detection.
Figure 7:
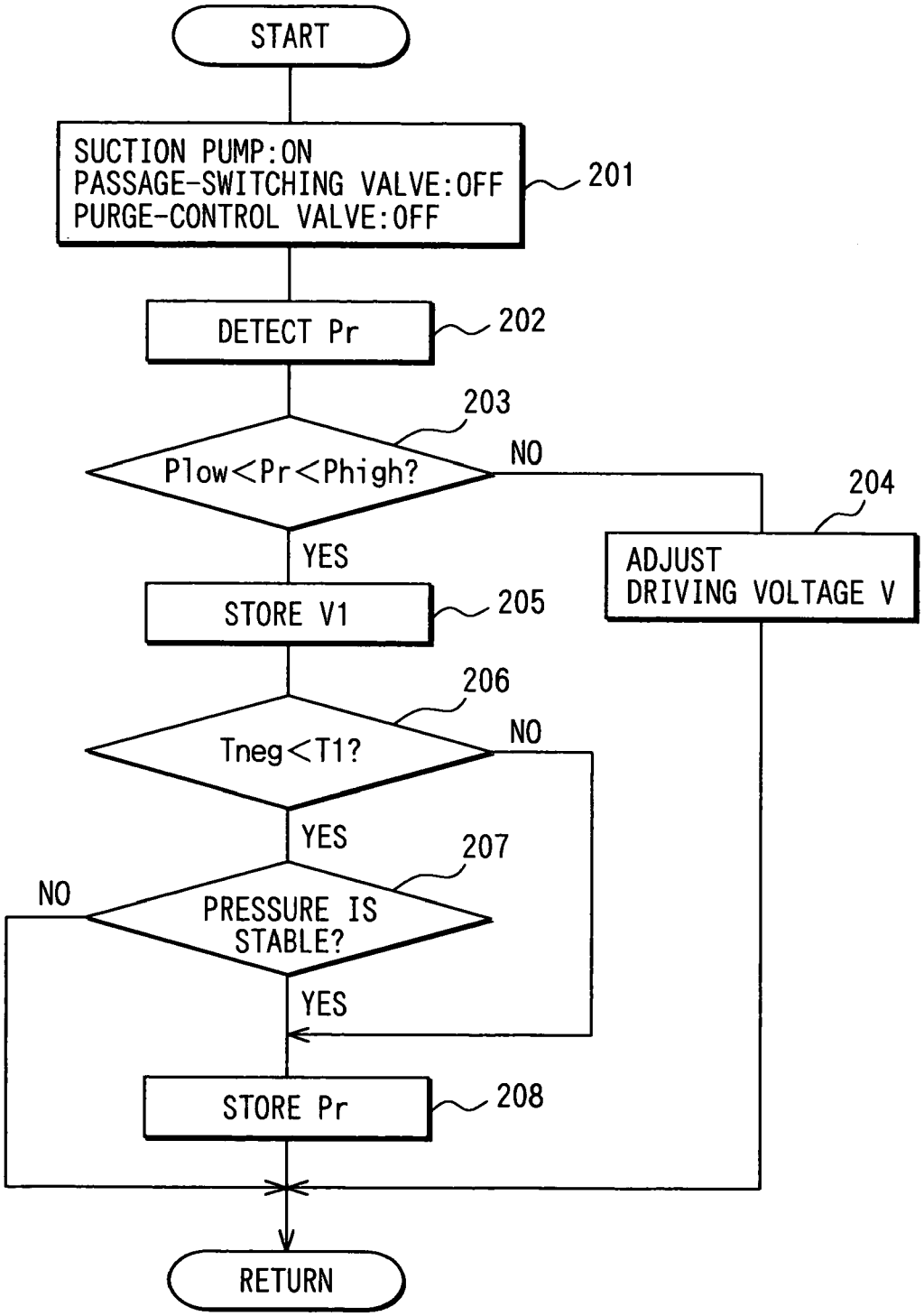
FIG. 7 is a flowchart showing a reference pressure detecting process.
Figure 8:
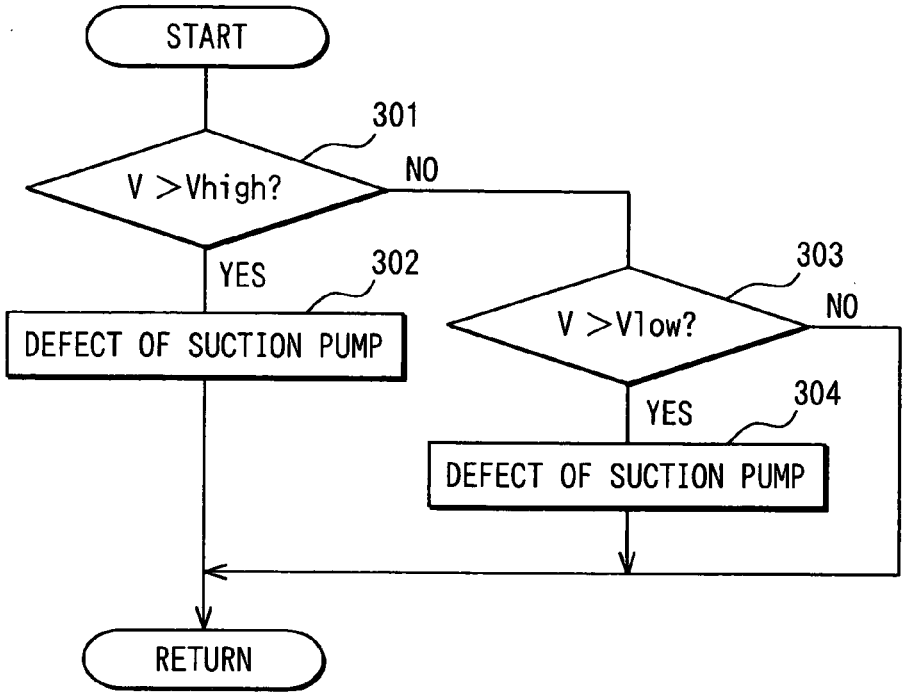
FIG. 8 is a flowchart showing a defect determination process.

Furthermore, the ECU 31 executes processes shown in FIGS. 6 to 8 so that the reference pressure and the pressure in the fuel vapor purge system are compared with each other to determine whether the leak exists.

Figure 4:
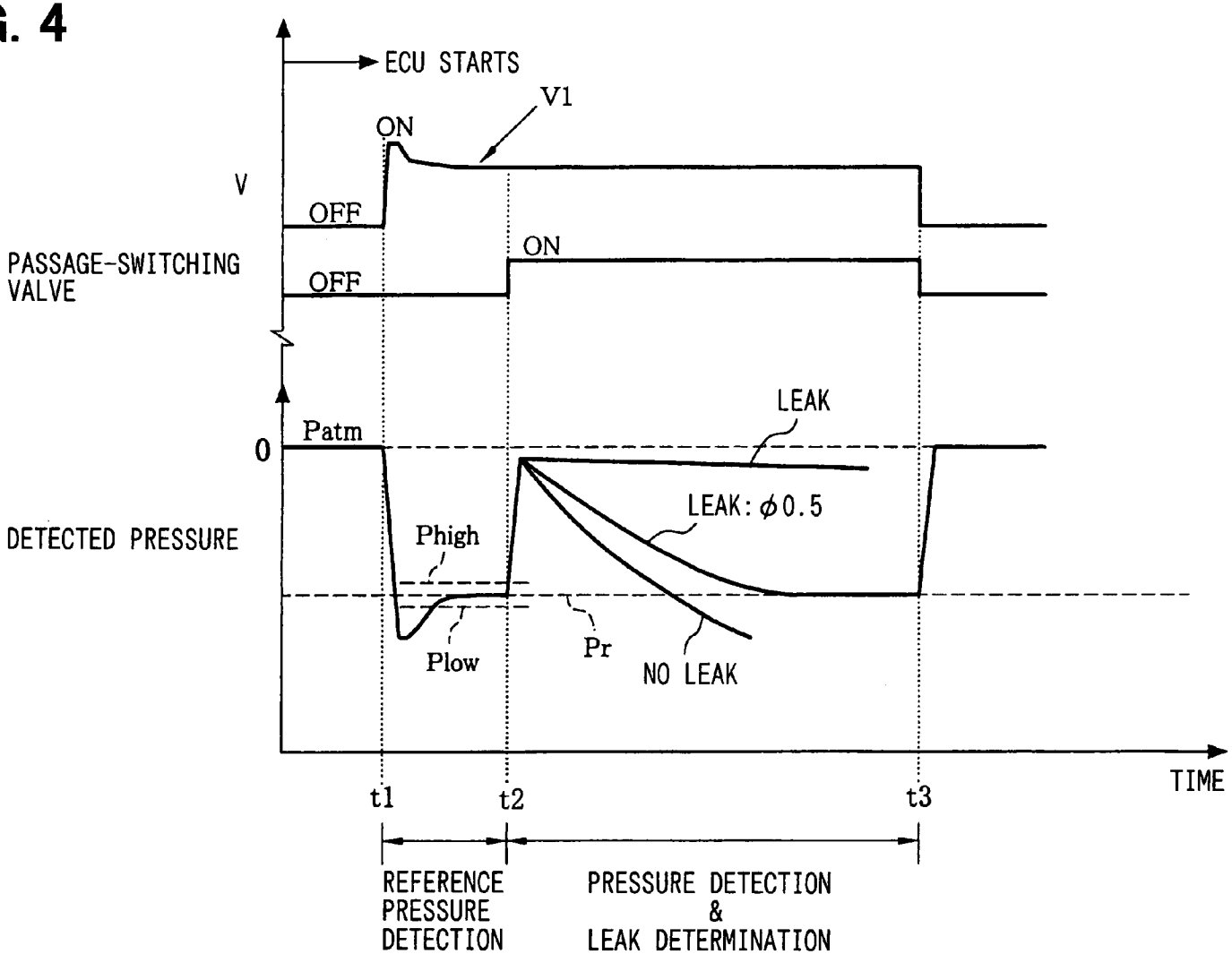
FIG. 4 is a time chart showing a leak detecting according to the first embodiment.

The leak detection of the fuel vapor purge system executed by the ECU31 is described hereinafter. As shown in FIG. 4, at the time of t1 in which a predetermined period (for example, three to nine hours) has passed since the engine was stopped, the reference pressure detecting operation starts. When the pressure sensor 27 is an absolute pressure sensor, the purge-control valve 15 is closed and the passage-switching valve 19 is brought to be at the atmosphere-releasing position in order that the pressure sensor 27 detects the pressure in the reference-pressure-detecting portion 26 as atmospheric pressure Patm, which is stored in a memory of ECU 31.

In a reference pressure detecting operation, the purge-control valve 15 is closed, the passage-switching valve 19 is kept at the atmosphere-releasing position, and then the suction pump 23 is driven, so that the negative pressure is introduced into the reference-pressure-detecting portion 26, as shown in FIG. 2. A driving voltage V for the suction pump 23 is adjusted in such a manner that the pressure Pr in the reference-pressure-detecting portion 26 is within a target pressure range (lower limit Plow<Pr<upper limit Phigh). When the pressure Pr is brought to be within the target pressure range, the driving voltage V for the suction pump 23 is stored in the memory of the ECU 31 as a first driving voltage V1.

At the time of t2 in which a time period T1 has passed since the negative pressure started to be introduced into the reference-pressure-detecting portion 26, it is determined that the negative pressure in the reference-pressure-detecting portion 26 is stable, so that the negative pressure detected by the pressure sensor 27 is stored in the memory of ECU 31 as a reference pressure Pr.

After the reference pressure Pr is detected, a pressure detection and a leak detection in the fuel vapor purge system are started. While the suction pump 23 is driven at the first voltage V1, the passage-switching valve 19 is switched into the negative-pressure introducing position to introduce the negative pressure into the fuel vapor purge system as shown in FIG. 3. Before a time period T2 is passed, if the pressure Pf in the fuel vapor purge system detected by the pressure sensor 27 is lower than a leak determining value (for example, the reference pressure Pr or a pressure which is smaller than the reference pressure Pr), the computer determines that there is no leak in the fuel vapor purge system. On the other hand, at the time t3 in which a time period T2 has passed since the negative pressure was introduced into the fuel vapor purge system, if the pressure Pf is greater than or equal to the leak determining value, the computer determines that there is a leak in the system. If the pressure Pf is close to the reference pressure Pr, it is determined that the leak hole is substantially the same as the reference orifice 25 of which diameter is reference leak diameter (for example, 0.5 mm). If the pressure Pf is greater than the reference pressure Pr, it is determined that the leak hole is larger than the reference orifice.

In the case that computer determines the leak hole exists, an alarm lump 36 is turned on to alert the driver, and the information of defect is stored in a nonvolatile memory such as a backup RAM (not shown) of ECU 31.

Figure 5:
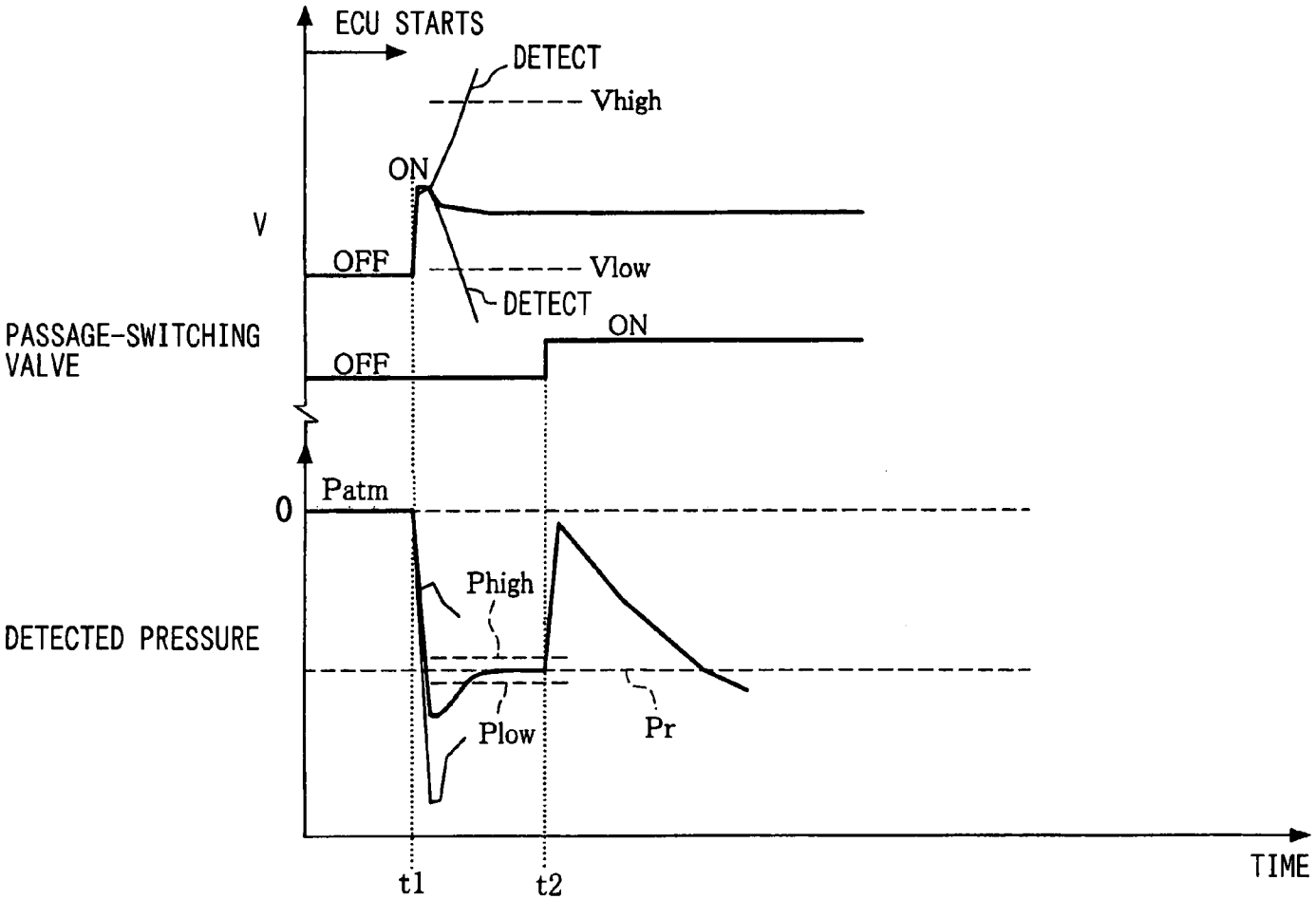
FIG. 5 is a time chart showing a defect determination process.

As shown in FIG. 5, when the driving voltage V of the suction pump 23 is within a normal range (Plow<Pr<Phigh), the suction pump 23 and the reference-pressure-detecting portion 26 have no defect. When the driving voltage V is out of the normal range, it is determined that the suction pump 23 and the reference-pressure-detecting portion 26 have defect, so that the leak detection is stopped and the leak detection result is cancelled.

Referring to FIGS. 6 to 8, the processes that the ECU 31 executes will be described hereinafter.

(Main Control for Leak Detection)

A main process for leak detection shown in FIG. 6 is executed every predetermined time after the ignition switch 33 is turned off and the main relay 32 is turned on by mean of the soak timer 35. This program corresponds to a leak detecting means.

In step 101, the computer determines whether a leak detection condition is established. The leak detection condition is established when following four conditions are satisfied.

(1) The battery voltage is higher than a predetermined voltage (for example, 10.5 V).

(2) The coolant temperature and the intake air temperature are higher than a predetermined temperature (for example, 4.4° C.).

(3) The atmospheric pressure Patm is within a predetermine range (for, example, 70 kPa<Patm<110 kPa).

(4) A predetermined period (for example, five hours) has been passed since the ignition switch 33 was turned off.

In the case that the above four conditions are fully satisfied, the leak detection condition is established. In the case that even one of the conditions is not satisfied, the leak detection condition is not established.

When the answer is No in step 101, the process ends without executing the following steps.

When the answer is Yes in step 101, the procedure proceeds to step 102 in which the computer determines whether it is in the reference pressure detecting period. When the answer is Yes in step 102, the procedure proceeds to step 103 in which a reference pressure detecting process shown in FIG. 7 is executed. That is, the suction pump 23 introduces the negative pressure into the reference-pressure-detecting portion 26, and the driving voltage V of the suction pump 23 is adjusted in such a manner that the pressure Pr in the reference-pressure-detecting portion 26 is within the target pressure range. The adjusted driving voltage V is stored in the memory as the first driving voltage V1, and the pressure in the reference-pressure-detecting portion 26 detected by the pressure sensor 27 is stored in the memory as the reference pressure Pr.

Then, the procedure proceeds to step 104 in which a defect determination process shown in FIG. 8 is executed. That is, the computer determines whether the suction pump 23 and the reference-pressure-detecting portion 26 have a defect according to whether the driving voltage V is within the normal range.

When the answer is No in step 102, the procedure proceeds to step 105 in which the computer determines whether it is in a system pressure detecting period. When the answer is Yes in step 105, the procedure proceeds to step 106 in which a process for detecting a pressure in the fuel vapor purge system and the leak determination process are executed. That is, the suction pump 23 is driven at the first voltage V1 to introduce the negative pressure into the fuel vapor purge system. Comparing the pressure Pf in the fuel vapor purge system with the leak determination pressure, the computer determines whether the leak exists and determines the size of the leak.

(Reference Pressure Detecting Process)

A reference pressure detecting process shown in FIG. 7 is a subroutine executed in step 103 of the main process shown in FIG. 6. In step 201, while the purge-control valve 15 is closed and the passage-switching valve 19 is at the atmosphere-releasing position, the suction pump 23 is driven in order to introduce the negative pressure into the reference-pressure-detecting portion. Then, the procedure proceeds to step 202 in which the pressure Pr in the reference-pressure-detecting portion 26 is detected by the pressure sensor 27.

Then, the procedure proceeds to step 203 in which the computer determines whether the pressure Pr in the reference-pressure-detecting portion 26 is within the target pressure range (Plow<Pr<Phigh). When the answer is No in step 203, the procedure proceeds to step 204 in which the driving voltage V of the suction pump 23 is adjusted in such a manner that the pressure Pr is within the target pressure range.

When the answer is Yes in step 203, the procedure proceeds to step 205 in which the driving voltage V is stored in the memory as the first driving voltage V1.

Then, the procedure proceeds to step 206 in which the computer determines whether a negative-pressure-introducing period Tneg is less than the predetermined period T1. When the answer is Yes in step 206, the procedure proceeds to step 207 in which the computer determines whether the pressure in the reference-pressure-detecting portion 26 is stable according to whether the variation speed of the pressure is slower than a predetermined speed. When the answer is No in step 207, the procedure ends.

When the answer is No in step 206 or the answer is Yes in step 207, the procedure proceeds to step 208 in which the pressure in the reference-pressure-detecting portion detected by the pressure sensor 27 is stored in the memory of ECU 31 as the reference pressure Pr.

(Defect Determination Process)

The defect determination process shown in FIG. 8 is a subroutine which is executed in step 104 of the main process shown in FIG. 6. In step 301, the computer determines whether the driving voltage V of the suction pump 23 is higher than an upper limit voltage Vhigh. When the driving voltage V is higher than the upper limit voltage Vhigh, the procedure proceeds to step 302 in which the computer determines the suction pump 23 or the reference-pressure-detecting portion 26 has a defect (for example, the characteristic of the suction pump 23 is dispersed toward the lower limit value).

When the answer is No in step 301, the procedure proceeds to step 303 in which the computer determines whether the driving voltage V of the suction pump 23 is lower than a lower limit voltage Vlow. When the answer is Yes in step 303, the procedure proceeds to step 304 in which the computer determines the suction pump 23 or the reference-pressure-detecting portion 26 has a defect (for example, the characteristic of the suction pump 23 is dispersed toward the upper limit value).

When the computer determines that the driving voltage V is within the normal range (Vlow≦V≦Vhigh), the computer determines the suction pump 23 and the reference-pressure-detecting portion 26 have no defect to end the procedure.

According to the first embodiment, since the driving voltage V of the suction pump 23 is adjusted in such manner that the pressure Pr is within the target pressure range, the negative pressure introducing condition can be made stable, so that the reference pressure Pr is always kept proper value to restrict a disperse of leak detection accuracy due to a disperse pf the reference pressure Pr.

Furthermore, since the suction pump 23 is driven at the first driving voltage V1, the negative pressure introducing condition is made stable. Thus, the leak detection can be conducted under proper negative pressure introducing condition, and the load applied to the fuel vapor purge system is restricted to enhance the durability of the fuel vapor purge system.

Besides, since the negative pressure introducing condition can be made stable with no affect of disperse of suction pump characteristic, a disperse of the leak detection period is restricted and a tolerance of the disperse of the suction pump characteristic is moderate.

According to the first embodiment, when the driving voltage V is adjusted, the computer determines whether the suction pump 2 and the reference-pressure-detecting portion 26 have a defect. Thus, the defect of the suction pump 23 and the like is early detected.

According to the first embodiment, since the suction pump 23 is used, even if a leak hole is generated in the fuel vapor purge system, the atmospheric air is introduced into the system through the leak hole and the fuel vapor hardly leaks toward the atmosphere through the leak hole. When the negative pressure is introduced, the amount of fuel vapor which is not adsorbed in the canister can be reduced.

Second Embodiment

Referring to FIGS. 9 to 12, a second embodiment will be described hereinafter.

In a case of detecting a leak hole which corresponds to a second aperture of which diameter (for example, 0.6 mm) is different from that of the reference orifice (for example, 0.5 mm), the reference pressure Pr is corrected according to the diameter of the second aperture. Comparing the corrected reference pressure Pr with the pressure Pf in the fuel vapor purge system, it can be determined whether a leak hole corresponding to the second aperture exists.

Figure 9:
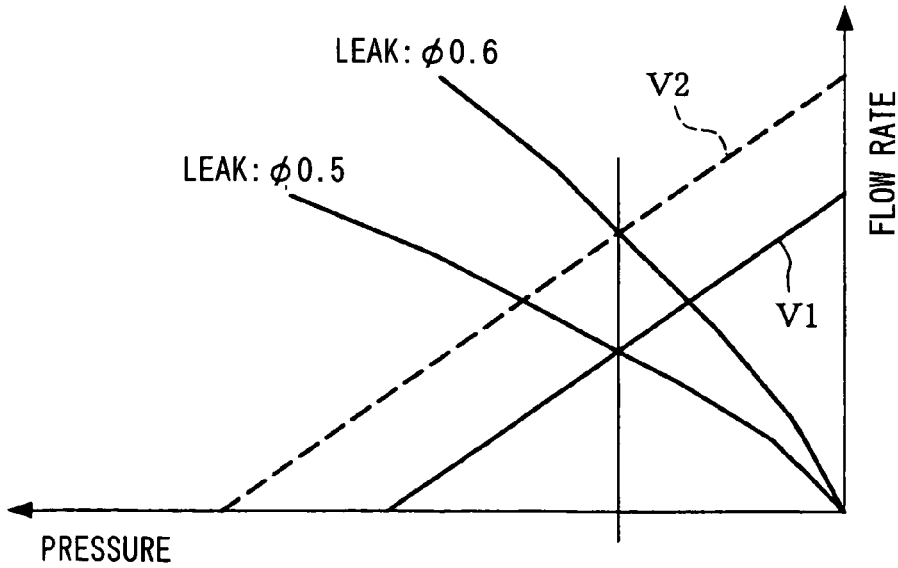
FIG. 9 is a graph for explaining a leak detection according to a second embodiment.

According to the second embodiment, as shown in FIG. 9, the first driving voltage V1 is corrected according to the diameter of the second aperture to obtain a second driving voltage V2. The suction pump 23 is driven at the driving voltage V2 when the pressure detecting process is conducted.

Figure 10:
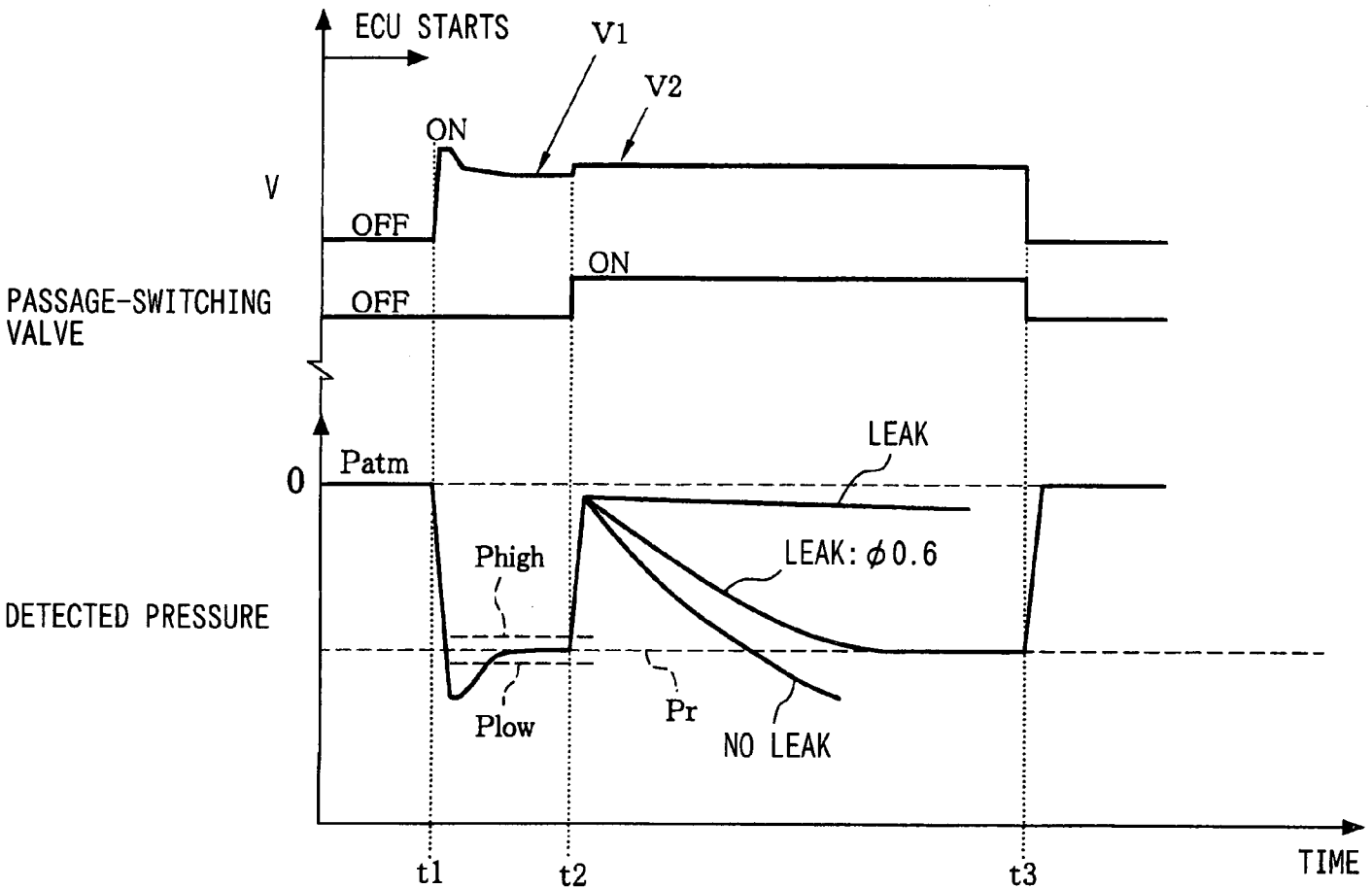
FIG. 10 is a time chart showing a leak detection according to a second embodiment.

As shown in FIG. 10, after the suction pump 23 is driven at the first driving voltage V1 to detect the reference pressure Pr, the suction pump 23 is driven at the second driving voltage V2 to detect the pressure Pf in the fuel vapor purge system. Comparing the reference pressure Pr with the pressure Pf, it is determined whether a leak hole corresponding to the second aperture exists.

Referring to FIG. 11, a second-voltage calculation process will be described hereinafter.

In step 401, a correction coefficient α corresponding to the second aperture is calculated based a correction coefficient table shown in FIG. 12. According as the diameter of the second aperture increases, the correction coefficient α increases. In the case that the diameter of the second aperture is equal to the diameter of the reference orifice (for example, 0.5 mm), the correction coefficient α=1.

Then, the procedure proceeds to step 402 in which the second voltage V2 is derived by correcting the first voltage V1 with he correction efficient α.

$$V2=V1\times\alpha$$

According to the second embodiment, without changing the reference pressure Pr, a leak hole corresponding to the second aperture can be detected to enhance the accuracy of the leak detection.

In the first and second embodiments, the suction pump 23 is used. The suction pump 23 can be replaces by a discharge pump. In the first and second embodiments, the pressure sensor 27 is used to detect the reference pressure and the pressure in the fuel vapor purge system. Instead of the reference pressure and the pressure in the fuel vapor purge system, kinetic characteristic of the suction pump 23, such as current, voltage, rotation speed, can be used, so that the pressure sensor 27 can be omitted.

The present invention is applied to not only the system in which the leak detection is conducted during engine is not running but also the system in which the leak detection is conducted during engine is running.

What is claimed is:

1. A leak detector for a fuel vapor purge system introducing a fuel vapor in a fuel tank into an intake pipe of an internal combustion engine, the leak detector comprising:

a pressure-introducing-detecting apparatus including a pressure introducing unit introducing a pressure into the fuel vapor purge system including the fuel tank;

a reference-pressure-detecting portion provided with a reference aperture having a predetermined inner diameter; and a switching unit switching between a passage for introducing pressure into the reference-pressure-detecting portion and a passage for introducing pressure into the fuel vapor purge system; and a leak determination unit detecting a reference pressure information representing a reference pressure adjusted by the reference aperture or correlated information of the reference pressure, the leak determination unit detecting a system pressure information representing a system pressure in the fuel vapor purge system or correlated information of the system pressure, the leak determination unit determining whether a leak exists by comparing the reference pressure information with the system pressure information, wherein the leak determination unit adjusts a control value of the pressure introducing unit using the reference pressure information as a target condition to set a first control value when the reference pressure information satisfies the target condition, and thereafter drives the pressure introducing unit at the thus set first control value during a leak detecting operation.

2. The leak detector according to claim 1, wherein the leak determination unit (a) sets a second control value by correcting the first control value when a leak hole corresponding to a second aperture of diameter different from that of the reference aperture is detected, and (b) drives the pressure introducing unit at the second control value.

3. The leak detector according to claim 1, wherein the pressure introducing unit is a suction pump which introduces negative pressure into the fuel vapor purge system.

4. The leak detector according to claim 1, wherein the pressure introducing unit is a discharge pump which introduces positive pressure into the fuel vapor purge system.

5. The leak detector according to claim 1, wherein the leak determination unit determines whether the control value is within a predetermined range when the control value of the pressure introducing unit is adjusted in order to determine whether a pressure-introducing-detecting apparatus has a defect.

6. The leak detector according to claim 1, wherein a kinetic characteristic of the pressure introducing unit is utilized as the reference pressure information and the system pressure information.

7. A method for detecting leaks in a fuel vapor purge system disposed between a fuel tank and an intake pipe of an internal combustion engine, said method comprising:

adjusting the drive power to a pump when connected with a reference orifice to achieve a target reference pressure and determining the corresponding drive power as a first control value;

driving said pump with said first control value when connected with said fuel vapor purge system; and performing a leak check by comparing (a) information correlated with said target reference pressure with (b) information correlated with a pressure of said fuel vapor purge system.

8. A method as in claim 7 further comprising:

adjusting drive power to said pump from said first control value to a second control value to achieve said target reference pressure when a leak hole is detected having a diameter different from that of the reference orifice, said second control value being correlated to the leak hole size as compared to the reference orifice size.

9. A method as in claim 7 wherein the pump is a suction pump which introduces negative pressure into the fuel vapor purge system.

10. A method as in claim 7 wherein the pump is a discharge pump which introduces positive pressure into the fuel vapor purge system.

11. A method as in claim 7 wherein if the adjusted control value is outside a predetermined range, the pump is determined to have a defect.

12. A method as in claim 7 wherein a kinetic characteristic of the pump is utilized as (a) reference pressure information and (b) system pressure information.

* * * * *